US005363350A

United States Patent [19]

Marr-André et al.

[11] Patent Number: 5,363,350

[45] Date of Patent: Nov. 8, 1994

[54] WATCH CASE WITH HOLLOWED-OUT CASEBAND

[75] Inventors: Miche Marr-André, Bienne; Loichot Aimé, Cortébert, both of Switzerland

[73] Assignee: SMH Management Services AG, Bienne, Switzerland

[21] Appl. No.: 157,320

[22] Filed: Nov. 26, 1993

[30] Foreign Application Priority Data

Dec. 2, 1992 [CH] Switzerland ..... 03 696/92-0

[51] Int. Cl.[5] ..... G04B 37/00; G04B 29/00

[52] U.S. Cl. ..... 368/276; 368/300

[58] Field of Search ..... 368/276, 280, 294–296, 368/299, 300, 309

[56] References Cited

U.S. PATENT DOCUMENTS

| | | | |
|---|---|---|---|
| 3,789,605 | 2/1974 | Kishida | 368/280 |
| 4,970,708 | 11/1990 | Gagnebin et al. | 368/300 |
| 4,995,023 | 2/1991 | Muller et al. | 368/276 |

FOREIGN PATENT DOCUMENTS

| | | |
|---|---|---|
| 571054 | 9/1923 | France . |
| 79203 | 7/1918 | Switzerland . |
| 131399 | 3/1928 | Switzerland . |
| 351545 | 1/1958 | Switzerland . |
| 664251 | 4/1986 | Switzerland . |

*Primary Examiner*—Vit W. Miska

*Attorney, Agent, or Firm*—Griffin Butler Whisenhunt & Kurtossy

[57] ABSTRACT

A watch case is made of gold with a caseband-bezel (11) hollowed-out in order to diminish the weight of gold as much as possible. To avoid dents in the caseband-bezel the hollow (26) is filled with metal, for example brass, which also serves as a casing ring (10) to secure the movement (13) to the case. The installation of such casing ring in the caseband hollow is possible only if the ring is made in at least four segments (1, 2, 3, 4 ) which are placed side-by-side and which are held in place by means guided in a groove (6) formed in the ring.

13 Claims, 6 Drawing Sheets

WATCH CASE WITH HOLLOWED-OUT CASEBAND

The present invention is relative to a watch case including a caseband-bezel provided with a hollow having a substantially arched profile opening out towards the interior of the case, a crystal and a back cover for retaining a movement surmounted by a dial and a casing ring arranged between the movement and the caseband.

BACKGROUND OF THE INVENTION

Watch cases are known formed preferably of precious metal (gold or platinum) the caseband of which is hollowed out on the interior in order to achieve a substantial economy of precious material and thus to allow a lower selling price than could be permitted if such caseband were solid.

Patent document CH-A-664 251 describes a watch case of gold in which the movement is fixed to the caseband-bezel which is hollowed out on the interior. Such fastening is obtained through a fitting piece which is centered by the interior. To this end an axial projection from the fitting piece is loosely fitted around a corresponding projection which is fixed to the case and which is constituted by a portion of a flange another part of which is squeezed between an internal lip of the caseband bezel and the crystal. The axial securing of the fitting piece is assured by a latching bolt which bears against the shoulder of the caseband and maintains the fitting piece supported under the lip.

Patent document EO-A-0 379 974 (=U.S. Pat. No. 4,970,708) also describes a watch case including a hollowed-out caseband in vault form. Such caseband includes first and second cylindrical support surfaces cooperating respectively with a crystal and a back cover. Three studs fixed to the caseband are arranged within the space defined by the vault-formed hollow. Each of the studs bears a projection extending towards the movement and borne by the case, said projection bearing an upper snap on which rests a flange against which the crystal is supported, and a lower snap on which rests a casing ring against which the back cover bears.

The hollowed-out casebands described in the documents cited hereinabove are fragile in the sense that they are sensitive to lateral shocks applied to the watch, the extreme thinness of the wall of the caseband explaining why this latter may be dented by the slightest blow thereagainst.

Resistance to shock has been improved by arranging ribs within the caseband as within the interior of the back cover as such is seen in patent document EP-A-O 378 125 (=U.S. Pat. No. 4,995,023). If improvements have been brought about in respect of the deforming of the caseband due to traction by the bracelet, such improvements are however minimum as to shock resistance, such caseband being easily dented because of its very small thickness (on the order of 0.15 mm).

It is noted in other respects that cases obtained according to the patents cited hereinabove give such an impression of lightness that one can be placed in doubt as to whether they are formed of gold. As it is not authorized to add weight which would be present only with the sole purpose of inducing belief in the presence of solid gold with neither function nor real utility for the constitution or the operation of the watch, the present invention imagines filling almost entirely the hollow of the caseband made of gold by a circle, preferably made of brass, such circle fulfilling two functions: that of a casing ring support for the movement and coupling of this latter with the caseband and that of reinforcement of the caseband for rendering it resistant to shocks, since behind the caseband made of thin gold is found said ring which renders the caseband subject to denting only with difficulty. It will be understood that additionally such ring makes the watch heavier.

SUMMARY OF THE INVENTION

With this purpose the present invention is characterized in that the casing ring is made up from a plurality of segments juxtaposed and partially engaged within the caseband hollow in order to overlay at least 85% of its periphery, the outer contour of said segments being formed so as to be in close contact with said substantially arched profile, means being applied so as to maintain said segments in place within said hollow.

The invention is now to be explained by means of the examples illustrated by the drawings.

DESCRIPTION OF THE PREFERRED EMBODIMENTS

Figure 1:
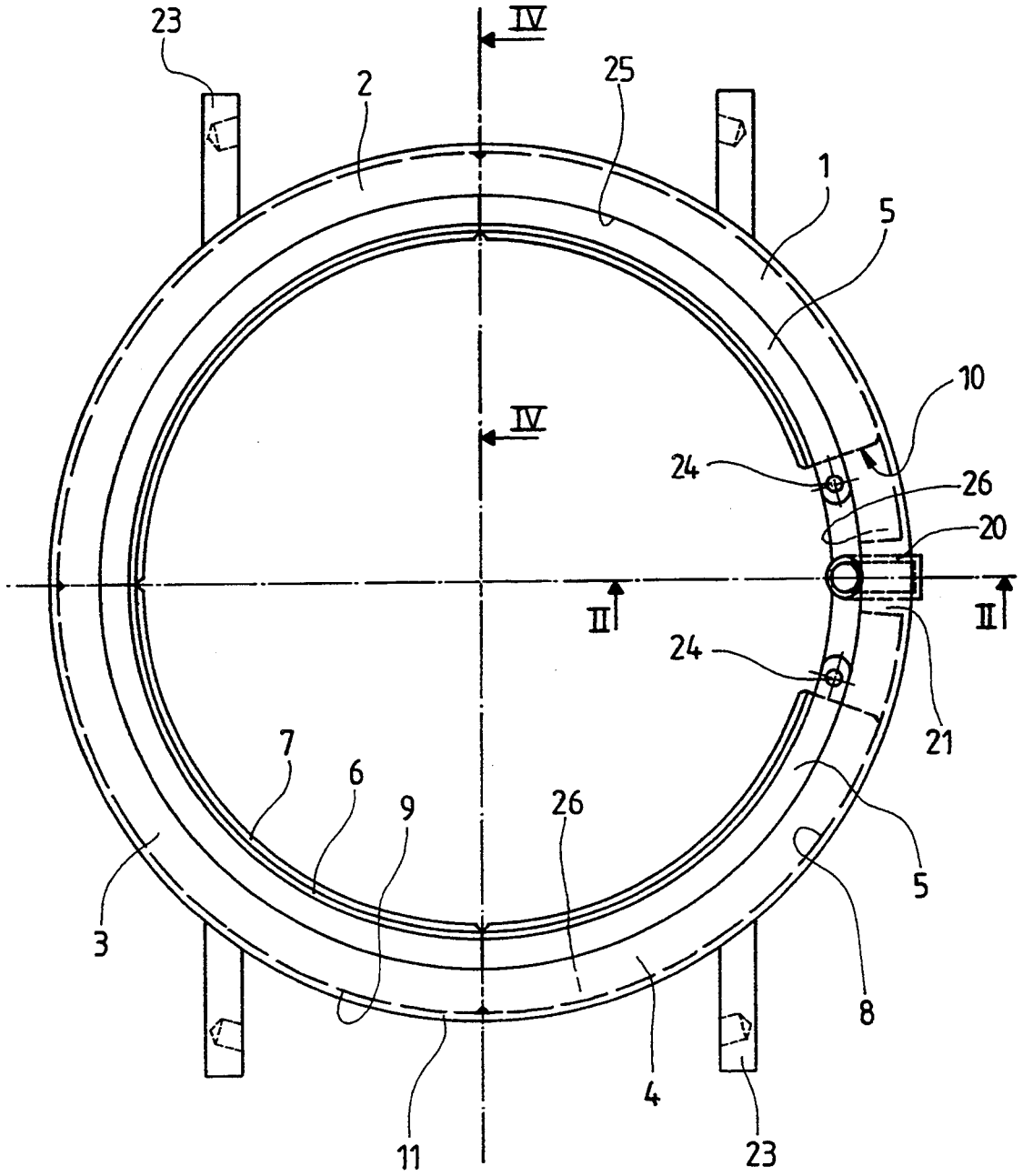
FIG. 1 is a plan view of the caseband according to a first embodiment of the invention in which caseband is found housed four segments making up a casing ring retained by an elastic ring.
Figure 2:
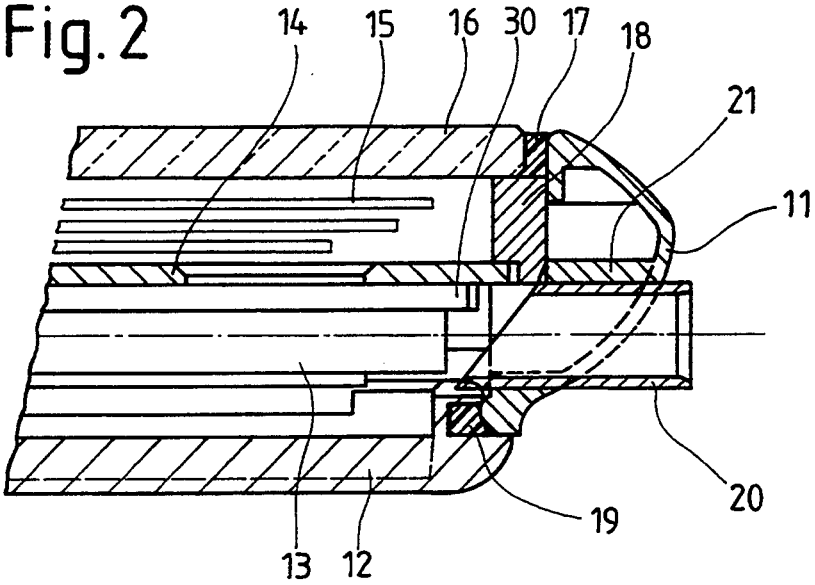
FIG. 2 is a cross-section along line II—II of FIG. 1.
Figure 3:
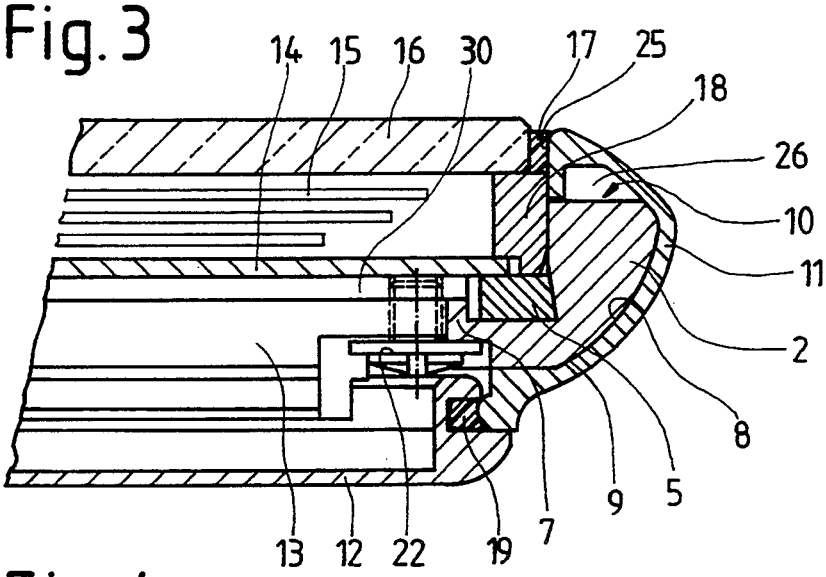
FIG. 3 is a cross-section of FIG. 1 at the place where is found one of the fastening clamps of the movement onto the casing ring.
Figure 4:
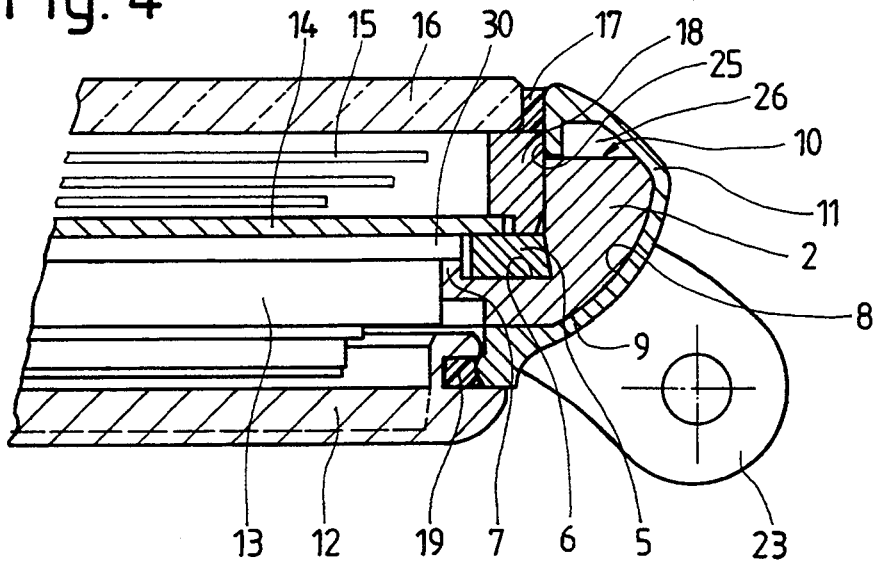
FIG. 4 is a cross-section along line IV—IV of FIG 1.

As is readily seen on FIGS. 2 to 4, the watch case includes a caseband-bezel 11 provided with a hollow 26 having a substantially arched profile 8 in the form of a vault opening out towards the interior of the case. The case is completed by a crystal 16 and a back cover 12 in order to contain a movement 13 surmounted by a dial 14. A casing ring 10 is arranged between movement 13 and the caseband 11. Hands 15 are located between the dial 14 and crystal 16, this spacing being well defined by a flange 18. Sealing of crystal 16 relative to the caseband 11 is assured by a cylindrical packing 17 which bears on a fall 25 formed in the top part of the bezel forming an integral portion of the caseband 11. The back cover 12 is snap-fastened onto caseband 11, its sealing being assured by a packing 19. It will be noted that such back cover could also be made integrally with the caseband, thus to form a monoshell case. Movement 13 is introduced from above into the caseband and bead 30 with which it is provided comes to bear on shoulder 7 of the casing ring 10. Movement 13 is fixed to the ring 10 by means of securing clamps, a single one 22 of which is visible on FIG. 3. As is seen on FIG. 2, a tube 20 traverses caseband 11 in which tube is placed the time setting stem of the movement (not shown). Since the wall of the caseband is very thin (on the order of 0.2 mm), there has been provided at the place of passage of such tube, a stiffener 21 for the caseband materialized by additional material added on or formed integrally with said caseband. Such stiffener 21 is also visible in the plan views of FIGS. 1, 6 and 8.

The hollowed-out caseband 11 may be formed by turning by means of form milling cutters or by stamping and folding back by means of a rotary press, according to the method described in the patent document EO-A-0 378 125 cited hereinabove, such method being chosen above all for the very large production runs and which, in addition, permits forming of lugs 23. In one case as in the other, it is sought to obtain a very thin wall as a measure of economy of precious material. However, as has been mentioned hereinabove, a caseband this thin withstands very badly shocks which are applied thereto during normal wear and is rapidly dented. Likewise the weight of the watch will cause doubts to arise that its case is made of precious metal since its caseband is hollowed out with the evident purpose of selling the product less dearly.

Solutions are brought for these problems by the essential characteristic of the present invention which consists in using a casing ring which fills up almost entirely the hollow of the caseband by closely fitting its interior profile. The casing ring formed of brass, for example, brings a solution to the weight problem, the problem of shock resistance being resolved by an intimate contact of the casing ring with the caseband in the periphery of this latter. To arrive at this purpose, the casing ring is composed of a plurality of segments, here four segments 1, 2, 3 and 4 as is seen on FIGS. 1, 6 and 8. Such segments are juxtaposed, partially engaged in the hollow 26 of the caseband and cover over at least 85% of its periphery. As is seen particularly well on FIGS. 3, 4, 7 and 9, the outer contour 9 of each segment is formed to be in close contact with the substantially arched profile 8 exhibited by the interior of caseband 11. In order to maintain such segments in place within the hollow, even prior to setting in the movement, recourse may be had to different means according to the chosen embodiment. Three different systems will be explained further on, all of which use a groove 6 having a substantially rectangular profile formed in each segment.

Figure 5:
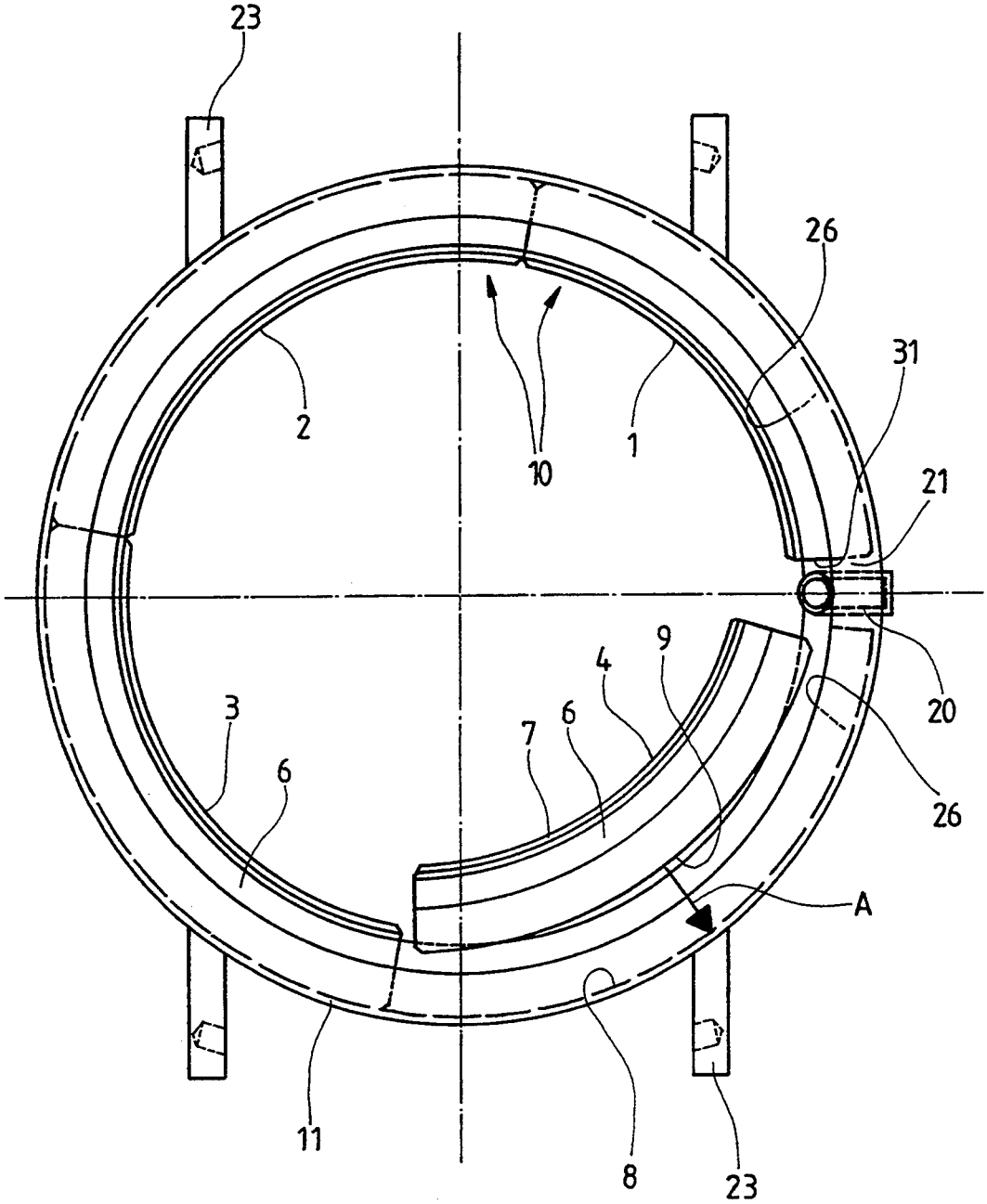
FIG. 5 shows how the segments making up the casing ring are assembled in the caseband-bezel.

FIG. 5 indicates how the segments are assembled in the caseband. One begins by the introduction of the first segment I in hollow 26 by bringing its end 31 to bear against the stiffener 21 of tube 20. The assembly of segments 2 and 3 is continued in the same manner. The last segment 4 is finally introduced into the caseband according to the direction of arrow A. The segments thus juxtaposed are then slid in a manner such that the empty portions situated to the right and to the left of tube 20 are of almost equal length. The number of segments to be provided will depend from several factors, in particular from the filling factor of the hollow and of the depth of the hollow. In the example shown on the drawing, the depth of the hollow 26 is such that four segments are necessary if one wishes to fill up at least 85% of the internal periphery of such hollow. Once the geometric equilibrium has been attained relative to the tube, the segments will be secured in order to maintain them in place, which facilitates subsequent assembly of the movement.

FIG. 1 shows a first embodiment of the invention, in which the means of maintaining segments 1, 2, 3 and 4 in place consists of an elastic ring 5 which is arranged in groove 6 formed in each segment. In order to facilitate the grasping or the lifting up of the ring, there have been provided two holes 24 which permit seizing it with a special tweezer. It is to be noted that ring 5 is seen in cross-section in FIGS. 2, 3 and 4.

Figure 6:
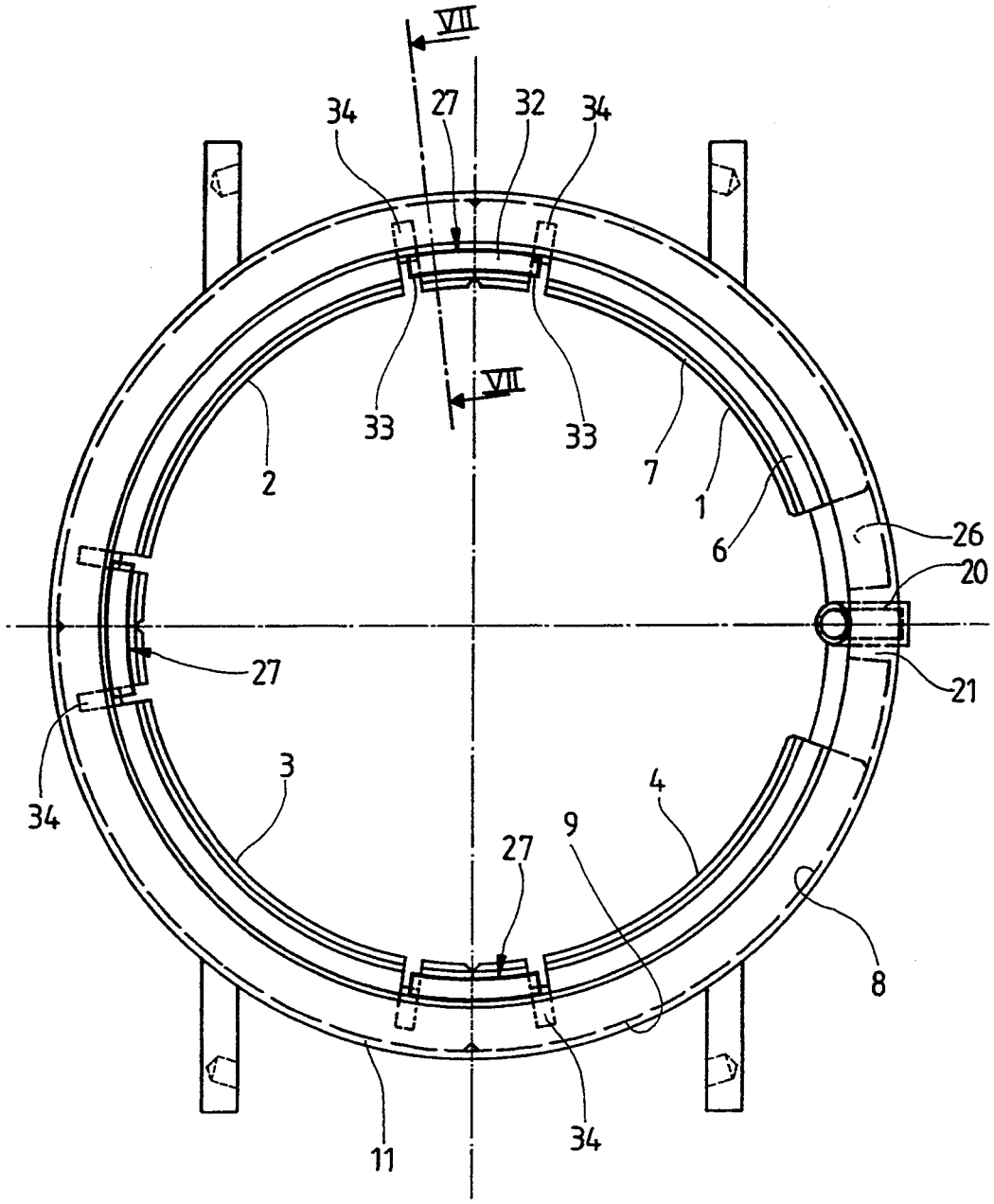
FIG. 6 is a plan view of the caseband according to a second embodiment of the invention, in which caseband four segments are housed making up a casing ring, retained following one another by elastic jumper links.
Figure 7:
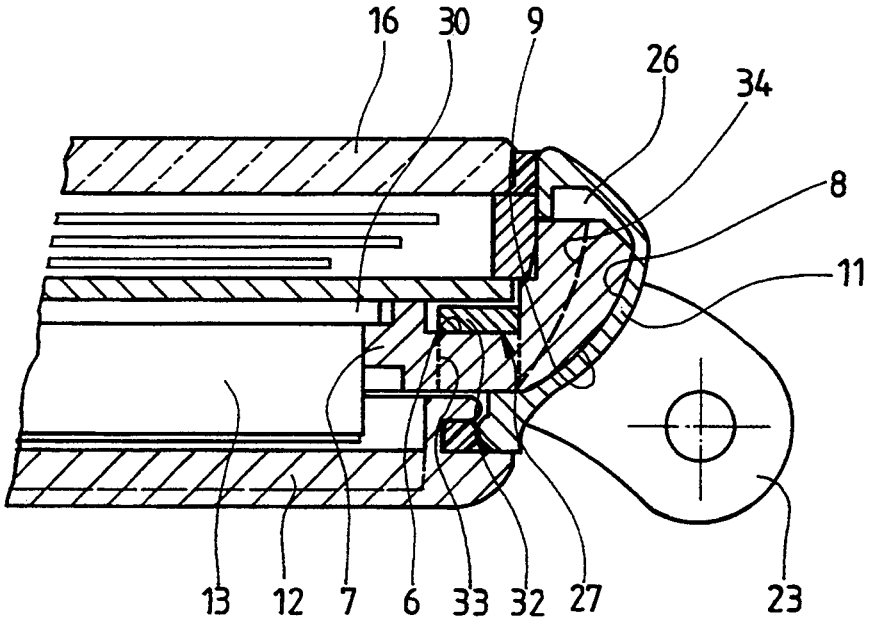
FIG. 7 is a cross-section along line VII—VII of FIG. 6.

FIGS. 6 and 7 show a second embodiment of the invention in which the means for maintaining segments 1, 2, 3 and 4 in place consist of an elastic jumper link 27. The top 32 of link 27 is arranged in grooves 6 already described, while the legs 33 are introduced into slots 34 formed towards the ends of the segments. FIG. 6 shows that three links 27 permit the coupling and holding in place of the four segments 1, 2, 3 and 4. There may be observed on FIG. 7 the bottom of slot 34.

Figure 9:
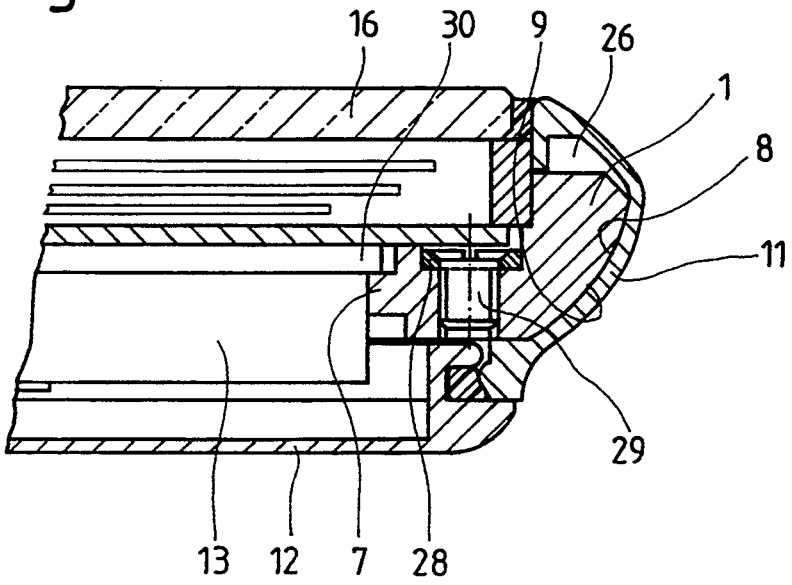
FIG. 9 is a cross-section along line IX—IX of FIG. 8.
Figure 8:
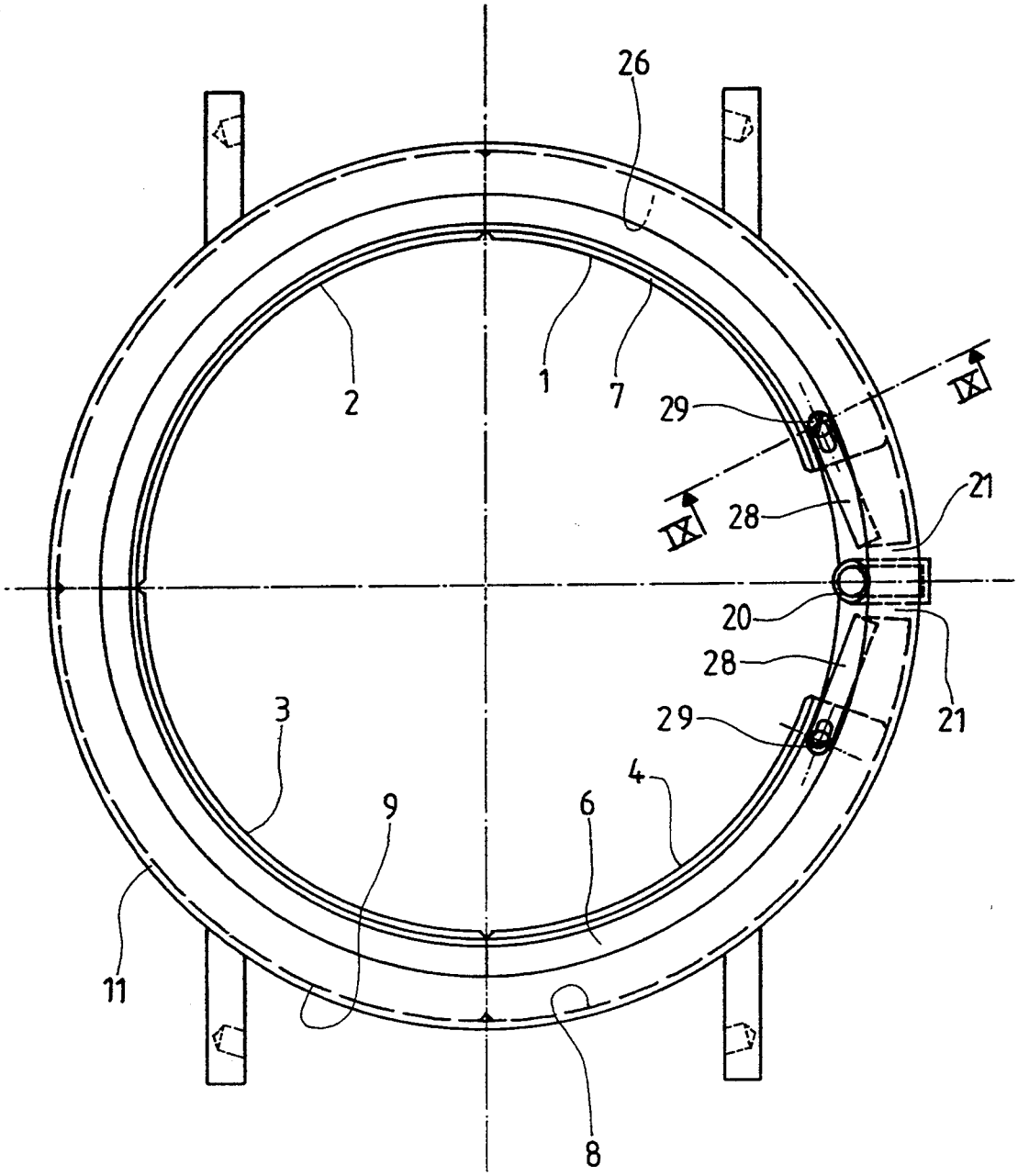
FIG. 8 is a plan view of the caseband according to a third embodiment of the invention, in which caseband are housed four segments making up a casing ring retained by two clamps bearing on either side on a reinforcement of the tube traversing the caseband.

FIGS. 8 and 9 show finally a third embodiment of the invention in which the means for maintaining segments 1, 2, 3 and 4 in place consist of two clamps 28, each bearing on the stiffener 21 of tube 20 as mentioned hereinabove. FIG. 8 shows that each of the clamps 28 is screwed into groove 6 in respect of segments 1 and 4 by means of screws 29.

All the examples cited hereinabove take account of a case made of two parts, namely the caseband bezel and back cover. It has been suggested that such case could be formed in a single piece. In order to be complete, one may add that such case could be formed of three pieces, the caseband being separated from the bezel and with a separate back cover. It will be understood that the special characteristics of the present invention can be applied as well to one or another of such embodiments.

What I claim is:

1. A watch case including a caseband-bezel provided with a hollow having a substantially arched profile opening out towards the interior of the case, a crystal and a back cover for retaining a movement surmounted by a dial and a casing ring arranged between the movement and the caseband, wherein the casing ring is made up from a plurality of juxtaposed segments partially engaged within the caseband hollow in order to overlay at least 85% of its periphery, the outer contour of said segments being formed so as to be in close contact with said substantially arched profile, maintaining means being applied so as to maintain said segments in place within said hollow, said maintaining means extending in a housing provided in said segments.

2. A watch case as set forth in claim 1, wherein the caseband-bezel and the back cover are of gold.

3. A watch case as set forth in claim 2, wherein the caseband-bezel and back cover are formed in one single piece.

4. A watch case as set forth in claim 1 wherein said housing comprises a groove having a substantially rectangular profile, said groove being provided in the portion of said segments which is not engaged within the hollow.

5. A watch case as set forth in claim 4, in which the portion of said segments which is not engaged within the hollow includes a shoulder on which the movement is supported.

6. A watch case as set forth in claim 5, in which said means for maintaining the segments in place consists of an elastic ring arranged in said grooves.

7. A watch case as set forth in claim 5, in which said means for maintaining the segments in place consists of an elastic jumper link arranged in said grooves and coupling together two juxtaposed segments.

8. A watch case as set forth in claim 5, in which said means for maintaining the segments in place consists of two clamps each bearing on a tube stiffening piece exhibited by the caseband, each of the clamps being screwed into the groove of one of said segments.

9. A watch case as set forth in claim 1, wherein the segments making up the casing ring are made of brass.

10. A watch case as set forth in claim 4, in which said means for maintaining the segments in place consists of an elastic ring arranged in said grooves.

11. A watch case as set forth in claim 4, in which said means for maintaining the segments in place consists of an elastic jumper link arranged in said grooves and coupling together two juxtaposed segments.

12. A watch case as set forth in claim 4, in which said means for maintaining the segments in place consists of two clamps each bearing on a tube stiffening piece exhibited by the caseband, each of the clamps being screwed into the groove of one of said segments.

13. A watch case including a caseband-bezel provided with a hollow having a substantially arched profile opening out towards the interior of the case, a crystal and a back cover for retaining a movement surmounted by a dial and a casing ring arranged between the movement and the caseband, the casing ring being made up from a plurality of juxtaposed segments partially engaged within the caseband hollow in order to overlay at least 85% of its periphery, the outer contour of said segments being formed so as to be in close contact with said substantially arched profile, means being applied so as to maintain said segments in place within said hollow, the portion of said segments which is not engaged within the hollow including a shoulder on which the movement is supported and a groove with a substantially rectangular profile serving to bear said means maintaining said segments in place.

* * * * *

UNITED STATES PATENT AND TRADEMARK OFFICE

CERTIFICATE OF CORRECTION

PATENT NO. : 5,363,350

DATED : November 8, 1994

INVENTOR(S) : Miche Marc-Andre, et. al.

It is certified that error appears in the above-indentified patent and that said Letters Patent is hereby corrected as shown below:

Title page, item [75], inventors: should read-- Miche Marc-Andre --.

Signed and Sealed this

Third Day of January, 1995

*Attest:*

Bruce Lehman

BRUCE LEHMAN

*Attesting Officer*

*Commissioner of Patents and Trademarks*